US007036635B2

(12) United States Patent
Rintala et al.

(10) Patent No.: US 7,036,635 B2
(45) Date of Patent: May 2, 2006

(54) SYSTEM AND DISPLAY FOR PROVIDING INFORMATION TO ELEVATOR PASSENGERS

(75) Inventors: Toni Rintala, Hyvinkää (FI); Mika Matela, Lahti (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/951,719

(22) Filed: Sep. 29, 2004

(65) Prior Publication Data

US 2005/0098391 A1 May 12, 2005

Related U.S. Application Data

(63) Continuation of application No. PCT/FI03/00307, filed on Apr. 16, 2003.

(30) Foreign Application Priority Data

Apr. 22, 2002 (FI) ..... 20020768

(51) Int. Cl.
*B66B 1/34* (2006.01)

(52) U.S. Cl. ..... 187/396; 187/391

(58) Field of Classification Search ..... 187/247, 187/391–398, 248

See application file for complete search history.

(56) References Cited

U.S. PATENT DOCUMENTS

| | | | | |
|---|---|---|---|---|
| 4,852,696 | A * | 8/1989 | Fukuda et al. | 187/392 |
| 4,989,694 | A | 2/1991 | Ueshima et al. | |
| 6,394,231 | B1 * | 5/2002 | Schuster et al. | 187/382 |
| 2001/0035314 | A1 * | 11/2001 | Yoshida et al. | 187/382 |
| 2003/0164267 | A1 * | 9/2003 | Hikita | 187/391 |
| 2004/0262093 | A1 * | 12/2004 | Forsythe et al. | 187/391 |

FOREIGN PATENT DOCUMENTS

| | | | |
|---|---|---|---|
| GB | 2 315 567 | A | 2/1998 |
| JP | 01242379 | A * | 9/1989 |
| JP | 2-127377 | A | 5/1990 |
| JP | 2 241 090 | A | 8/1991 |
| JP | 04169484 | A * | 6/1992 |

* cited by examiner

*Primary Examiner*—Jonathan Salata
(74) *Attorney, Agent, or Firm*—Birch, Stewart, Koalsch & Birch, LLP

(57) ABSTRACT

A system and display for providing guidance to elevator passengers generates call data and transmits the call data to the group control systems of one or more elevator banks. The group control systems process the call data to produce group call data and distribute the group call data to an elevator controller of the elevator bank. The guidance system also includes a display device which displays the group call data for one or more group control systems.

10 Claims, 3 Drawing Sheets

SYSTEM AND DISPLAY FOR PROVIDING INFORMATION TO ELEVATOR PASSENGERS

FIELD OF THE INVENTION

Figure 1:
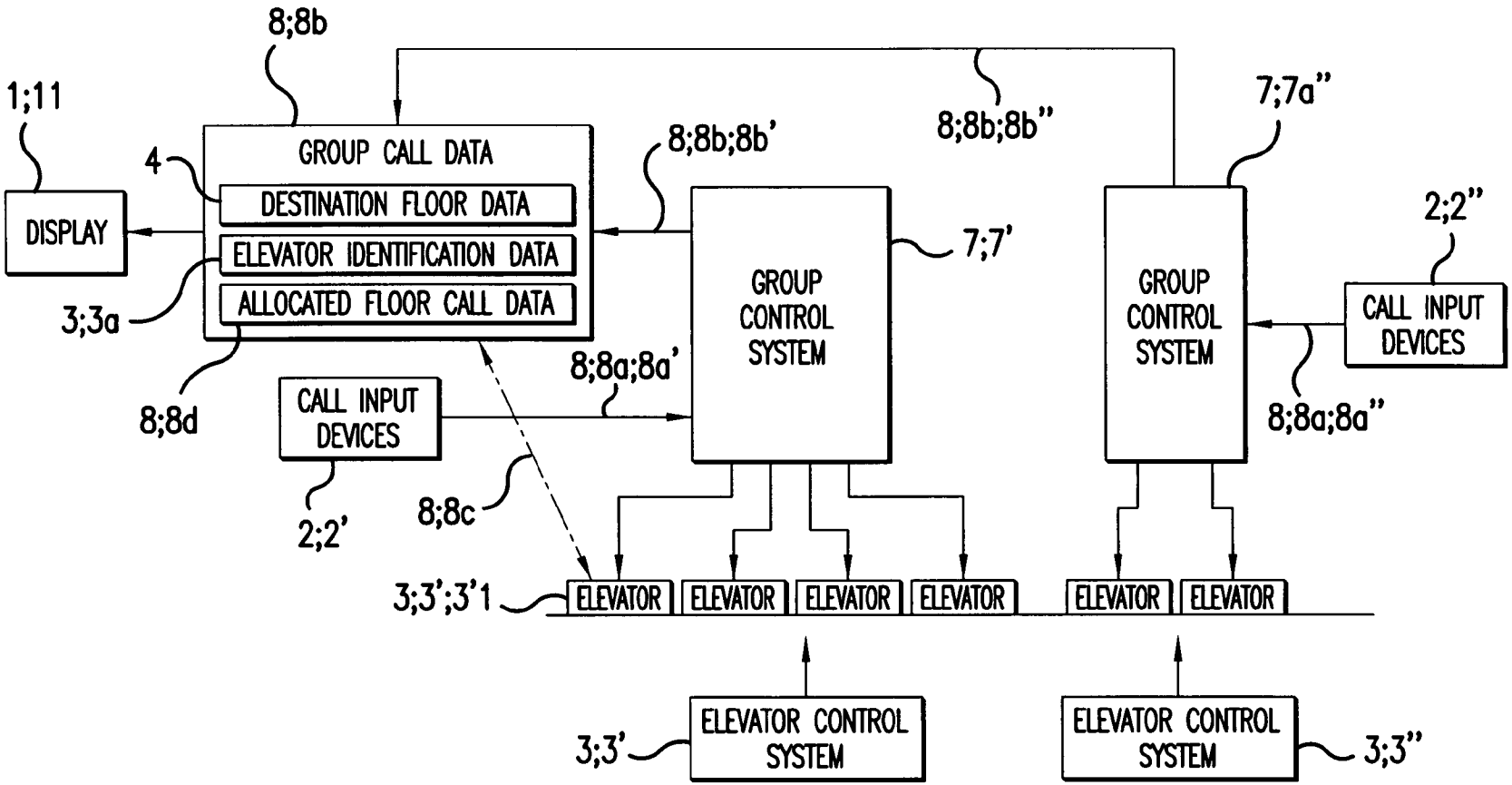

The present invention relates to a system and display for providing information to elevator passengers, and, more specifically, to a system and display for providing information to elevator passengers that includes virtual call data.

BACKGROUND OF THE INVENTION

Today, high buildings are almost invariably provided with several elevator banks, each of which can transport passengers to different parts/different floors and zones in the building. One elevator bank typically comprises 4–8 elevators. The operation of the elevators comprised in the elevator bank is controlled by a group control system of the elevator bank, which receives landing calls for the elevators in the elevator bank. Landing calls are issued to the group control system via landing call input devices, such as landing call keys, or they are virtual calls obtained from a data processing system. In addition to landing call input devices, calls can be given in most elevator systems by means of car call input devices provided in the elevator cars, but these calls are generally not transmitted to the group control system of the elevator bank. The landing call input devices on different floors are generally up/down call keys placed outside the elevator bank, which are common to all the elevators in the elevator bank, although in some systems the landing call input devices on the floors are floor call devices used to give a desired destination floor. The landing call keys used in the entrance hall are invariably floor call keys.

After the calls have been transmitted to the group control system by any method, the said group control system will allocate these group calls to the elevator control systems comprised in the elevator group by utilizing a suitable control algorithm. In general, the control algorithm aims at minimizing the passengers' call time and/or journey time. After this, the elevator control systems carry out the group calls assigned (allocated) to them, yet also taking the car calls issued from the elevator car into account. In some cases the elevator group is implemented using only elevator group specific landing call input devices at the floors and lobbies but no car call input devices in the elevator cars. Thus, in these control systems, no car calls are given at all; instead, all calls are landing calls, which the group control system receives, processes and distributes to the lower-level elevator control systems.

In this context, "elevator group" and "elevator bank" refer to two or more elevators which are situated close to each other and have common landing call input devices and whose operation is coordinated by a common group control system.

"Landing call" here refers to a call transmitted to the group control system from outside the elevator car. A landing call may also consist of a completely virtual call produced by a data processing system.

"Car call" refers to a call issued from inside the elevator car.

"Call" in general again refers to a landing call, car call or virtual call. A virtual call is a call produced by a data processing system and is therefore not necessarily related to calls produced by actual persons. However, virtual calls are generally produced by a logic that emulates calls given by actual persons as realistically as possible.

The ease of transport and the length of total traveling time from an elevator lobby in a building having one or more elevator banks to different floors are dependent first on the call time, i.e. the time from the instant the passenger has given an elevator call until the instant when an elevator going in the right direction arrives at the passenger's floor. In addition, the length of the total traveling time on the elevator ride time, i.e. the time from the instant the person enters the elevator to the instant when the person arrives at the desired destination floor. Moreover, the total traveling time is often increased by a time of transition from the entrance hall to the right elevator bank and elevator especially in large buildings. The transition time may be fairly long if the building has several elevator banks of which the person must first select and identify the right elevator bank and then find in the respective elevator bank the fastest elevator going to the destination floor. The traveling time and the call time can be reduced by technical means, such as by developing the control algorithm used in the group control system, whereas the transition time can not be reduced by merely developing the group control system of the elevator bank, because it involves a time delay that is primarily dependent on the spaces in the building and the quality of the guidance systems intended to guide the passengers.

In a guidance system known from specification "TMS9900 System with Destination Consultation Stations", written by Marja-Liisa Siikonen and Johannes De Jong, a display board placed above each elevator in the elevator bank and showing the floors to which the respective elevator is going is used to reduce the transition time.

However, a display board like this does not eliminate the problem arising from the circumstance that a person cannot find the right elevator bank at all in a complex building having several elevator banks or that the passenger further has to select the right elevator from among a relatively large number of elevators in a bank.

SUMMARY OF THE INVENTION

The present invention aims at eliminating the problems encountered in prior art. Thus, the object of the invention is to achieve a guidance system that allows the time required for transition to an elevator bank to be significantly reduced while helping passengers to quickly choose the right elevator in an elevator bank.

The guidance system of the invention comprises means for producing call data and means for transmitting call data to the group control systems of one or more elevator banks, which control systems process the call data to produce group call data and allocate said group call data to the elevator control means of the elevator bank. The guidance system comprises a display device used to show group call data of one or more group control systems.

The display device of the invention comprises receiving means for receiving group call data coming from one or more group control systems and the display elements of the display device form a unitary display, which is used to display at least the floor call data comprised in the aforesaid group call data for the elevator bank. Floor call data includes elevator identification data and destination floor data. The elevator identification data may comprise elevator car and/or bank data and/or elevator lobby data.

The passenger is thus shown the floor allocation data for several elevators on the same display. This provides the notable advantage that the passenger can quickly check which is the right elevator bank and elevator lobby if the building has several elevator banks. In the invention, the display of the same display device can be used to display the destination floor data for all elevators in the elevator bank, thus making it easy for the passenger to select an elevator going to the right floor.

In a preferred embodiment of the invention, the display device is also used to display the times of arrival of elevators at the elevator lobby, traveling times to different floors, elevator status data and data indicating whether a given elevator is working in destination mode or in normal mode. The elevator status data comprise e.g. data indicating elevator maintenance breaks, faults, etc. "Destination mode" again means that no car calls to destination floors can be issued from the elevator car, so the elevator will go to different floors only on the basis of calls transmitted to the group control system. "Normal mode" means that car calls to destination floors can be issued from the elevator car. The display device of the invention again affords the considerable advantage of enabling the passenger to quickly verify which elevator will provide the fastest ride to a given floor. From the point of view of the group control system, this display device provides several advantages: passengers can be guided by the display to use the right elevators; passengers going to congested floors receiving the largest numbers of destination floor calls can be guided to use elevators operated in destination mode and only stopping at these floors, whereas other users can be guided to use elevators in which it is possible to give car calls from the elevator car.

In another preferred embodiment of the invention, some of the floor call data presented on the display of the display device are virtual floor call data, in other words, data referring to virtual floor calls, which are converted into real calls by the car call input devices in the elevator cars. Such a display device provides the advantage that the operation of the call input devices and the display device can be easily changed according to the numbers of passengers; in peak traffic hours, such as in the morning and in the evening, it is possible e.g. to allow the use of landing call input devices only and inactivate the car call input devices, thus causing the elevators to operate in destination mode only. Outside peak hours it is possible to enable the operation of both landing call input devices and car call input devices, in which case both landing calls and possible car calls will be shown on the display. In patent specification GB 2241090, Godwin describes landing call input devices placed in an elevator lobby that can function during peak hours as destination floor keys used to input the number of the desired floor and as traditional up-down keys at other times.

In another preferred embodiment of the invention, some or all of the floor call data presented via the display device refer to virtual calls produced by statistical means by a data processing system. If the forecast virtual group calls are clearly representative of the real passenger traffic to different floors, then it is possible to achieve a considerable acceleration of the passenger flow by this type of system.

The use of a display device with a single unitary display also facilitates traffic between different elevator banks; when a passenger arrives in a first floor zone on an elevator of a first elevator bank and then has to move to a second floor zone, which can not be reached by the elevators of this elevator bank, the right elevator bank/elevator can be shown to the passenger by means of a display device placed on the transfer floor.

In the foregoing, only a few advantages achieved by the invention have been described. In the following, the invention will be described in detail with reference to the drawings and other additional advantages achievable by the method of the invention are described at the same time.

BRIERF DESCRIPTION OF THE DRAWINGS

FIG. 1 visualizes the generation of group call data and their transfer to a display device used in the guidance system of the invention.

Figure 2:
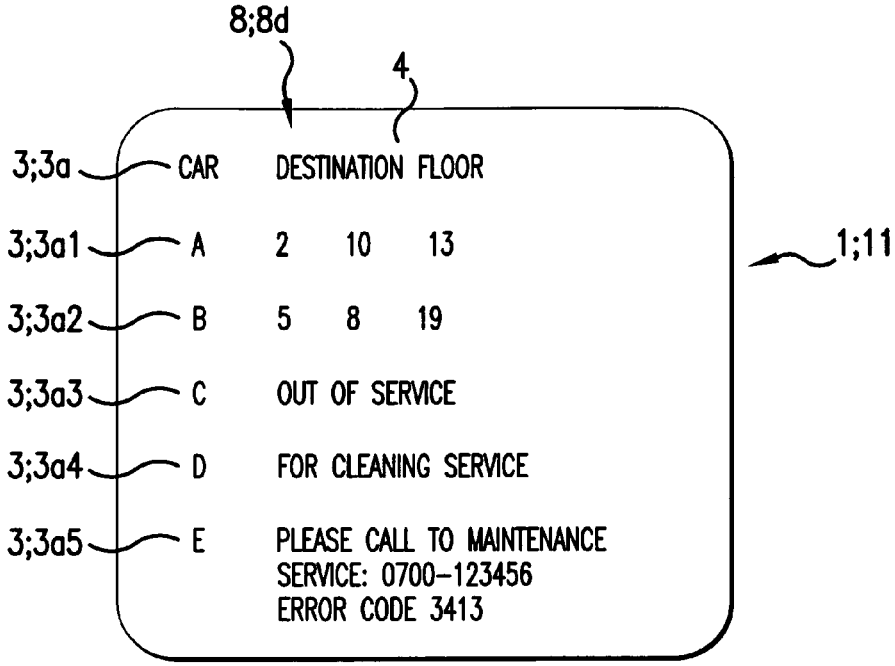

FIG. 2 presents a display device according to the invention, designed for one elevator bank.

Figure 3:
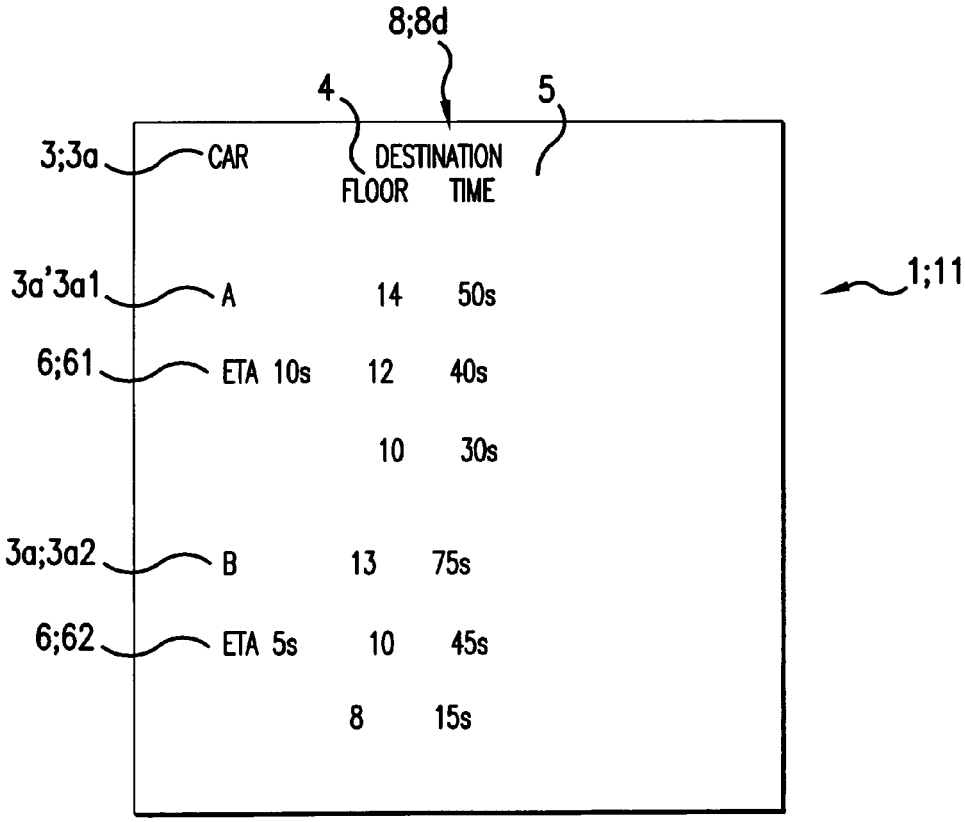

FIG. 3 presents a display device for one elevator bank according to the invention, used to give passengers additional information about elevator arrival times at floors.

Figure 4:
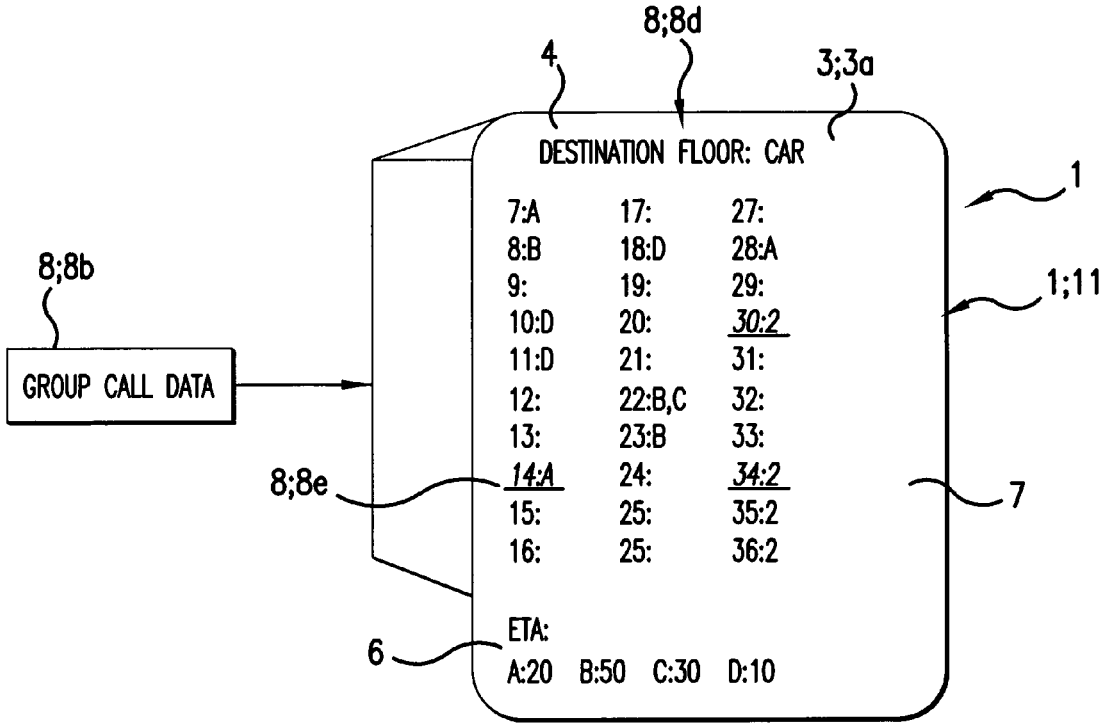

FIG. 4 presents a display device according to the invention designed for several elevator banks.

DETAILED DESCRIPTION

FIG. 1 presents a simplified representation of the generation of group call data and their transfer to the display device 1 used in the guidance system of the invention. The guidance system is used to generate, collect and display floor call data for the elevators of to two different elevator banks. In the guidance system, the functions of the elevators of the two elevator banks are controlled by two different group control systems 7:7' and 7; 7", which control the operation of the elevators comprised in the respective elevator banks via the elevator control system 3. The group control systems 7 receive floor-specific call data from call input devices 2, distribute the received call data to the elevator control systems and then send information regarding the group calls allocated to the elevator control systems to the display device 1. Each individual group call data comprises at least elevator identification data 3; 3*a* and destination floor data 4, i.e. data indicating the destination floors allocated to the elevator in question.

Connected to the first group control system 7; 7' shown on the left are four elevators, which are controlled by separate elevator control systems 3; 3' of the aforesaid elevators. Connected to the group control system 7; 7" on the right are two elevators, which are controlled by the elevator control systems 3; 3" of these elevators.

Each group control system receives landing calls 8 from the call input devices 2. Group control system 7; 7' receives landing calls 8; 8*a*; 8*a'* from the landing call input devices 2; 2' on the left, and group control system 7; 7" receives landing calls 8; 8*a*; 8*a"* from the landing call input devices 2:2" on the right. The group control systems 7 process the landing calls 8; 8*a* according to their own control algorithm and then allocate these landing calls to the respective elevator-specific control systems; 3; 3' 3". The group control systems 7; 7',7" of the elevator banks send the information regarding landing calls 8; 8*a* allocated to elevators further as group call data 8; 8*b*; 8*b'*, 8*b"* to the display device 1. The group call data 8; 8*b* comprise elevator floor call data 8; 8*d* containing the identification data 3; 3*a* of at least one elevator in the elevator bank, identified e.g. according to elevator door, and additionally data indicating to which floors the identified elevator has been allocated, i.e. the destination floor data 4 for the elevator. As there may be display devices 1 disposed in different locations and on different floors in the building, the allocated floor call data 8; 8*d* to be displayed are fitted according to the location of the display device. The group call data 8; 8*b* may also comprise other elevator group specific information as will be explained in the examples described below.

The control systems 3 of the elevators execute the landing calls allocated to them by the group control systems 7. Car calls can also be carried out from some or all of the elevators, and the car call data 8; 8*c* can be displayed via the display device 1 if desirable. The car call data 8; 8*c* sent to the display device 1 are represented in FIG. 1 by a broken line. In the figure, the car call data have been sent from elevator control system 3; 3'; 3'1. The car call data include elevator/elevator group identification data and data indicating the floor to which the identified elevator has been allocated (destination floor data).

In the display 11 of the display device 1 presented in FIG. 2, designed to show the floor call data 8; 8*d* for one elevator group, the first column displays elevator identification data 3; 3*a*; 3*a*1–3*a*5 by showing the elevator door identifier A . . . E, while the second column displays destination floor data 4 and elevator status information. In the present case, only elevators A and B are available for transportation, elevator A serving floors 2, 10 and 13 while elevator B serves floors 5, 8 and 19. The elevator identified by elevator door C is being cleaned, the elevator identified by elevator door D is out of service and the elevator identified by elevator door E has just now undergone a failure. Under elevator door E, the display also shows an error code, allowing maintenance personnel to easily locate and correct the fault.

From the above-described elevator-bank specific display 1; 11, the passenger can easily verify that the elevator allocated for him really goes to the destination floor and is not, for instance, out of service. A display according to FIG. 1 is thus preferably placed in a location close to the elevator bank.

In the display device 1; 11 in FIG. 3, the display again shows floor call data 8; 8*d* for the elevators. The first column in the display again displays elevator identification data 3*a*; 3*a*1; 3*a*2 by using elevator doors, in this case doors A and B. However, the first column now additionally displays the estimated time of arrival ETA 6; 61, 62 of the elevator to the floor from which the call has been issued. The second column displays the destination floor data 4 regarding the floors served by each elevator in the same way as in example 1. However, the third column now additionally shows the traveling time 5 required for each elevator to reach the destination floors 4 allocated to it. The estimated time of arrival 6; 61 of the elevator identified by elevator door A is 10 seconds, and the elevator serves destination floors 10, 12 and 14. The estimated time of arrival 6; 62 of the elevator identified by elevator door B is 5 seconds, and the elevator serves destination floors 8, 10, and 13. A display device 1 like the one presented in FIG. 3 is designed to guide and encourage passengers to use the elevator that is most advantageous in respect of time, without actual destination control, where no car calls can be issued from the elevator car. Thus, for example, in the situation presented in FIG. 3, for a passenger going to destination floor 10, it would be more advantageous to use the elevator identified by elevator door A than elevator B, although the estimated time of arrival 6; 62 for elevator B is shorter than the estimated time of arrival 6; 61 for elevator A. By using elevator A, the total time for reaching floor 10 is 40 seconds, while the total time for reaching floor 10 by using elevator B is 50 seconds.

The call input devices used in connection with the display device of FIG. 3 may consist of e.g. destination floor keys provided both in the elevator car and in the elevator lobby. In actual destination control, only landing call input devices are used, which are usually destination floor keys from which the calls are transmitted via the group control system to the display device. When the group control system is working in destination mode, the elevator car 1 generally has no car call input devices at all or their use is limited only to the periods outside peak traffic hours. Both the display 1; 11 shown in FIG. 2 and the one shown in FIG. 3 receive their group call data via call receiving elements from the elevator-bank specific group control systems 7 as illustrated in FIG. 1. The group call data 8; 8*b* contain at least the floor call data 8; 8*d* for the elevators, i.e. the elevator identification data 3; 3*a* and the calls allocated to the elevators, i.e. the destination floor data 4 for the elevators. In addition, the group call data may comprise elevator-specific additional information, such as elevator status data and estimated times of arrival.

In the case of a special call, the call input device shows the elevator identification data 3; 3*a* to the passenger having given the call, but no destination floor data 4 for the elevator in question is shown on the display of the display device, and therefore nobody else can select this elevator reserved for a special service.

FIG. 4 presents a display device 1 placed in an elevator lobby for an elevator bank 1 and serving the elevator banks presented in FIG. 1.

The display 11 of the display device 1 shows the elevator identification data 3; 3*a*, indicating which elevator (defined by elevator doors A . . . D) or elevator group has been allocated to transport passengers to the destination floors 4. The display device 1 receives the group call data 8; 8*b* and the additional information regarding the elevators from the group control systems of different elevator banks via the receiving elements of the display device. As for the generation of group call data 8; 8*b*, reference is made to FIG. 1, where the landing call 8; 8*a* is transmitted by a call input device 2, such as floor call keys, located in the elevator lobby to the group control systems 7*a* of the elevator banks 7, and the group control systems allocate the data to the elevator control systems of the elevators in the elevator bank and then send the information regarding the allocated group calls 8; 8*b* to the display device 1. Some of the group calls 8; 8*b* are virtual floor calls, which are produced by computer software. The virtual, predicted floor calls 8; 8*e* are shown underlined on the display 11. If the predicted calls have to be acknowledged using elevator car specific call input keys, then the information regarding these car calls is also passed via the group control system to the display device.

The receiving elements of the display device comprise data collecting and processing means, such as a microprocessor connected to the display via a suitable data bus. The aforesaid group call data 8; 8*b*, which include floor call data 8; 8*d* for the elevators, i.e. identification data 3; 3*a* for identifying the elevator and/or elevator bank and/or elevator lobby and destination floor data 4 for the elevators, are subsequently displayed by the display elements 11 of the display device 1, which constitute a unitary display. The display elements may form e.g. a plasma display, liquid crystal display or electroluminescence display, which have structures known in themselves. The floor call data 8; 8*d* are used to present information giving the destination floors 4 of the elevators and the identification data 3; 3*a* for the elevators allocated to the destination floors.

The display 11 of the display device 1 has two parts. The first part contains three different columns, which are used to display the destination floor data 4 and the identification data 3; 3*a* for the elevators allocated to the destination floors, defined as elevator door identifiers. One elevator 3; 3*a* may have several doors, the use of which is governed by the group control system for the elevator in question, so the elevator in question has several identifiers. The estimated time of arrival (ETA) 6 of the elevator defined by the elevator door at the elevator lobby or at the call floor is presented in the second part. The display device of FIG. 1 shows the group call data 8; 8*b* for the elevators of two different elevator banks. There may be several elevators allocated to the same floor, in which case the passenger can decide from the times of arrival 6 which one of the elevators is preferable. The elevators in the first elevator bank can be used to reach floors 7 . . . 29 and the elevators in the second elevator bank to reach floors 30 . . . 36. The elevators in the first elevator bank are identified by numbers A . . . D and the elevators in the second elevator bank by number 2; for the second elevator bank, no specific elevators are given. For elevator A, passengers have been allocated from the elevator lobby to floors 7, 14 and 28. For elevator B of the same bank, passengers have been allocated from the elevator lobby to floors 2, 22 and 23, for elevator C to floor 22 and for elevator D to floors 10,11,18. In addition, for the elevators in the second elevator bank, which are defined by the number "2" on the display, passengers going to floors 34, 35, 36 have been allocated. For the second elevator bank, no specific elevators or times of arrival are given because this elevator bank is situated in a different location.

If the display 11 of the display device 1 already shows an identified elevator/elevator door reserved for the destination floor desired by the passenger, instead of having to use a call input device the passenger can directly select an elevator already reserved (allocated) to take passengers to the destination floor. If passengers having given no call are felt to be a problem, the floor call data 8; 8*d* to be presented on the display 11 of the display device 1 can be shown with a delay so that passengers having given a call can move to the door of the right elevator before others become aware of the allocation made.

The display 1 described above also shows floor call data 8; 8*d* obtained from the group control system 7; 7*a*; 7*a*″ of the second elevator bank presented in FIG. 1, but such data are not displayed separately for each elevator but only at the elevator bank level. In the floor call data 8*d* relating to the second elevator bank, the elevator is only identified by referring to the elevator bank by the number "2". However, it would be advantageous to present elevator-specific floor call data for the second elevator bank is the display 1; 11 illustrated in the figure were located on a so-called transfer floor, where passengers transfer from the first elevator bank to the second elevator bank. In this case, the passenger would only have to give one floor call 8 in the elevator lobby of the first elevator bank and it would be possible to send an elevator of the second elevator bank to the transfer floor beforehand so that it would be ready for the passenger and be shown on the display of the display device on the transfer floor. In this way, passengers could give a call at any floor to any floor even if they had to change elevators one or more times on the way. The display device 1 of the invention allows the passenger to continuously keep track of which elevator and which elevator bank he should go to next.

The display device presented in FIG. 4 provides the advantage, especially in peak traffic hours, that all passengers need not necessarily give an elevator call; instead, they can check directly from the display device 1 whether a suitable elevator is going to their destination floor. Giving a call always takes a few seconds per passenger, so the display device allows passengers to get sooner on board of an elevator especially during inbound peak hours.

The above-mentioned predicted floor calls 8; 8*e* are obtained by gathering traffic statistics about the use of the elevators in different elevator banks in the building and compiling traffic statistics from the passenger flows and deducing from these statistics the probable destination floors at given times by a method known in itself, such as by using suitable genetic algorithms having a learning capacity, as described e.g. in "TMS9900 System with Destination Consultation Stations" by Marja-Liisa Siikonen, Johannes De Jong. The predicted floor call data 8; 8*e* can be combined with monitoring of arrival of passengers in the elevator bank lobby. The frequency of passenger arrivals is observed e.g. by means of personal wireless devices as described in GB patent specification GB 2241090, and for the arriving passenger a call is executed which is displayed on the display 11 of the display device.

If the floor call data 8; 8*d* presented on the display of the display device consist partially or completely of predicted data and the predicted calls correspond closely to actual floor calls given by passengers, then the landing call input devices 2 in the elevator lobby may be conventional elevator-bank-specific up-down keys, and elevators called in this manner do not necessarily even need any elevator-car-specific car call input devices, or these devices can be inactivated during peak traffic hours. In a fully automatic system, all the floor calls presented on the display of the display device are predicted calls 8; 8*e*. In practice, an elevator control system based on predicted calls can primarily be used for controlling some of the elevators in an elevator bank during morning peak hours.

In the foregoing, only a few preferred embodiments of the invention have been described, but it is obvious to the skilled person that the invention can be implemented in many other ways within the scope of protection defined in the claims.

Thus, the display 1 in FIG. 3 shows only one estimated time of arrival (ETA) 6 at the elevator lobby from where the elevator call has been given, but it can also be used to present other information regarding the elevators, such as e.g. information about the movement of the elevators.

The invention claimed is:

1. Passenger guidance system, comprising means for generating call data and means for transmitting call data to the group control systems of one or more elevator banks, said group control systems processing the call data to produce group call data and distributing the said group call data to the elevator control means of the elevator bank, said guidance system comprising display device, which is used to display the group call data for one or more group control systems, characterized in that at least some of the floor call data presented on the display of the display device are virtual floor call data.

2. Guidance system according to claim 1, characterized in that the virtual floor call data presented on the display of the display device are activated as floor calls by means of call input devices in the elevator cars.

3. Guidance system according to claim 1 or 2, in which the data displayed on the display of the display device additionally comprises the time of arrival of the elevator at the floor from which the call has been given, elevator traveling times to destination floors and elevator status information characterized in that the data on the display device additionally comprises information regarding elevators operated in destination mode and/or normal mode.

4. Display device for the guidance of passengers, in which the display device comprises receiving means for receiving group call data coming from one or more group control systems, the display elements of the display device form a unitary display, which is used to display at least the floor call data, said call data includes at least elevator identification data and destination floor data allocated to the elevators, characterized in that at least some of the floor call data presented on the display consists of virtual floor call data.

5. Display device according to claim 4, in which the floor call data also include information regarding the time of arrival of the elevator at the floor from which the call has been given, elevator traveling times to destination floors, and elevator status information, characterized in that the floor call data also include information regarding elevators operated in destination mode and/or normal mode.

6. Display device according to claim 4 or 5, characterized in that the receiving means of the display device are also used to receive car call data, which are displayed on the display.

7. Display device according to claim 4 or 5, characterized in that, of the elevator identification data, only the elevator bank and/or elevator lobby is displayed.

8. An elevator control system comprising:

a group controller controlling a group of elevators, said group controller receiving call data from call data inputs, processing said call data, and sending floor call data to at least one elevator controller; and a display displaying floor call data for each elevator in the group of elevators based on said call data inputs and on virtual call data.

9. The elevator control system of claim 8 including call input devices in each of the elevators for selecting a floor identified by virtual floor call data on the display.

10. The elevator control system of claim 8 wherein said display includes an elevator arrival time, an elevator traveling time and elevator status information.

* * * * *